US012396550B2

(12) United States Patent
Jiang

(10) Patent No.: US 12,396,550 B2
(45) **Date of Patent: *Aug. 26, 2025**

(54) EXPANDABLE FOLDING TABLE WITH REMOVABLE INSERT PANEL ASSEMBLY

(71) Applicant: YIXIANG BLOW MOLDING FURNITURE CO., LTD., Yuyao (CN)

(72) Inventor: Jinglei Jiang, Yuyao (CN)

(73) Assignee: YIXIANG BLOW MOLDING FURNITURE CO., LTD., Yuyao (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/642,105

(22) Filed: Apr. 22, 2024

(65) Prior Publication Data

US 2024/0268550 A1 Aug. 15, 2024

Related U.S. Application Data

(63) Continuation of application No. 18/138,740, filed on Apr. 25, 2023, now Pat. No. 11,963,611, which is a continuation of application No. 17/655,340, filed on Mar. 17, 2022, now Pat. No. 11,684,151.

(30) Foreign Application Priority Data

Nov. 10, 2021 (CN) ..... 202122738112.5

(51) Int. Cl.
*A47B 1/04* (2006.01)
*A47B 1/10* (2006.01)

(52) U.S. Cl.
CPC . *A47B 1/04* (2013.01); *A47B 1/10* (2013.01)

(58) Field of Classification Search
CPC .... A47B 1/04; A47B 1/10; A47B 1/02; A47B 1/03; A47B 2001/053
See application file for complete search history.

(56) References Cited

U.S. PATENT DOCUMENTS

| | | | | |
|---|---|---|---|---|
| 1,063,642 | A | 6/1913 | Birdsall | |
| 1,766,694 | A | 6/1930 | Siskin | |
| 2,707,138 | A | 4/1955 | Vangor | |
| 3,336,883 | A * | 8/1967 | Wengi | A47B 1/03 108/86 |
| 4,475,464 | A | 10/1984 | Deconinck | |
| 5,806,437 | A * | 9/1998 | Huang | A47B 1/02 108/86 |
| 5,927,212 | A | 7/1999 | Huang | |
| 6,705,234 | B1 | 3/2004 | Miller et al. | |
| 9,622,568 | B1 * | 4/2017 | Lin | A47B 13/081 |

(Continued)

*Primary Examiner* — Daniel J Rohrhoff

(57) ABSTRACT

The present subject matter discloses a removable panel assembly for an expandable folding table. The removable panel assembly includes a movable panel and a frame that is retractable. The expandable frame also includes a fixed frame connected with a pivot device and a movable frame. The movable panel is foldable and can be horizontally arranged between two panels of the folding tables when it is in use. Furthermore, the movable panel can be stored under the fixed frame when it is collapsed. With the removable panel assembly, the table can be both foldable and extendable without structural interference. In addition, while being easy to operate, the removable panel assembly further enhances the functions and appearance of the table.

15 Claims, 9 Drawing Sheets

(56) References Cited

U.S. PATENT DOCUMENTS

| | | | | |
|---|---|---|---|---|
| 9,738,295 | B1 * | 8/2017 | Horowitz | B62B 1/20 |
| 10,709,234 | B1 | 7/2020 | Brennan | |
| 11,478,070 | B1 | 10/2022 | Horowitz et al. | |
| 11,684,151 | B2 * | 6/2023 | Jiang | A47B 1/04 108/86 |
| 11,793,303 | B1 * | 10/2023 | Chen | A47B 1/10 |
| 11,963,611 | B2 * | 4/2024 | Jiang | A47B 1/03 |
| 2003/0192459 | A1 | 10/2003 | Annas | |
| 2007/0012226 | A1 * | 1/2007 | Chen | A47B 1/03 108/86 |
| 2009/0095204 | A1 * | 4/2009 | Levy | A47B 7/02 108/17 |
| 2013/0047898 | A1 * | 2/2013 | Lee | A47B 1/03 108/86 |
| 2013/0269574 | A1 | 10/2013 | Cooper | |
| 2014/0331903 | A1 | 11/2014 | Massimini | |
| 2015/0245716 | A1 | 9/2015 | Hwang | |
| 2018/0344023 | A1 * | 12/2018 | Andersson | A47B 1/08 |
| 2020/0093256 | A1 | 3/2020 | Mansson et al. | |
| 2021/0227968 | A1 | 7/2021 | Togni | |
| 2022/0183456 | A1 | 6/2022 | Arbeitman et al. | |
| 2022/0287450 | A1 * | 9/2022 | Benard | A47B 1/08 |
| 2022/0338615 | A1 | 10/2022 | Andersson et al. | |
| 2022/0400845 | A1 * | 12/2022 | Choi | A47B 3/002 |
| 2023/0157443 | A1 | 5/2023 | Jiang et al. | |
| 2023/0157444 | A1 | 5/2023 | Jiang et al. | |

* cited by examiner

EXPANDABLE FOLDING TABLE WITH REMOVABLE INSERT PANEL ASSEMBLY

CROSS-REFERENCES TO RELATED APPLICATIONS

This application is a continuation of U.S. patent application Ser. No. 18/138,740, entitled "EXPANDABLE FOLDING TABLE WITH REMOVABLE INSERT PANEL ASSEMBLY" filed Apr. 25, 2023, which is a continuation of U.S. patent application Ser. No. 17/655,340, entitled "EXPANDABLE FOLDING TABLE WITH REMOVABLE INSERT PANEL ASSEMBLY" filed Mar. 17, 2022, which claims the benefit of and priority to CN Patent Application No. CN202122738112.5, entitled "Expandable Folding Table with Movable Panel," filed Nov. 10, 2021, all of which are incorporated herein by reference in their entirety for all purposes.

TECHNICAL FIELD

The present subject matter is in the field of furniture design and manufacture. More particularly, embodiments of the present subject matter relate to a retractable panel assembly for an expandable folding table that renders the table length adjustable.

BACKGROUND

An expandable table can be extended by an extra panel when there are more table space needed. However, since the traditional expandable table cannot be folded, the design of the extra panel needs to overcome structural interference with the folding function of the table.

A folding table can be folded to reduce the storage space and makes it convenient to carry. However, although the traditional folding table can be folded, the table top cannot be expanded. After being unfolded, the length of the table top can not be adjusted or extended according to the number of seats needed. An example of such a folding table structure is disclosed in Chinese Patent No. CN207428721U.

Therefore, there is a need for a retractable insert panel for an expandable folding table, which enables the folding and extending function without interference with each other.

SUMMARY OF THE SUBJECT MATTER

The present subject matter can solve the technical problem as described herein by providing a removable panel assembly for an expandable folding table in view of the present art.

The technical solution adopted in the technical problem to be solved by the present subject matter is as follows: a retractable panel assembly for an expandable folding table, comprising: a movable panel and a first frame that is expandable, wherein the first frame includes a fixed frame connected with a pivot device and a movable frame, wherein the movable frame is configured to slide on the fixed frame through a sliding rail device between the movable frame and the fixed frame so that the movable panel can be horizontally arranged between the first panel and the second panel to extend the expandable folding table when it is in use, and wherein the movable panel can be hidden under the first panel when it is collapsed, and wherein the movable panel is foldable and rotatably connected to the fixed frame.

According to some embodiments, the movable panel is foldable with a first board and a second board that is connected to each other, and wherein the first board and the second board are either connected by hinges or by a flexible integrated structure.

According to some embodiments, the fixed frame includes a longitudinal front fixed beam and a longitudinal rear fixed beam, and a horizontal left fixed beam, and a horizontal right fixed beam, wherein the longitudinal front fixed beam and the longitudinal rear fixed beam are respectively connected to the front and rear of the pivot device, wherein the horizontal right fixed beam is connected between the front and rear of the pivot device, wherein the movable frame includes a longitudinal front movable beam and a longitudinal rear movable beam, and the longitudinal front movable beam and the longitudinal rear movable beam are slidably arranged on the longitudinal front fixed beam and the longitudinal rear fixed beam, and wherein the middle beam is a longitudinal beam connected between the horizontal left fixed beam and the horizontal right fixed beam; and wherein the movable panel is rotatably connected to a middle beam of the fixed frame.

According to some embodiments, the sliding rail device further comprises the longitudinal front fixed beam and the longitudinal rear fixed beam, each being provided with fixed sliding rail grooves with rolling elements; the longitudinal front movable beam and the longitudinal rear movable beam are provided with movable sliding rail grooves configured to match with the rolling elements; and a limiting structure for limiting the movable sliding rail grooves on the fixed sliding rail grooves.

According to some embodiments, the rolling elements are one of a roller, or a bearing, or a roller.

According to some embodiments, the movable panel assembly further comprises an anti-detachment device between the first board and the second board when the expandable folding table is folded. According to some embodiments, the anti-detachment device is a magnet that can attach the first board and the second board to each other.

DESCRIPTION OF DRAWINGS

The present subject matter is illustrated by way of example, and not by way of limitation, in the figures of the accompanying drawings and in which.

DETAILED DESCRIPTION

The present subject matter pertains to improved approaches for a removable panel assembly for an expandable folding table. Embodiments of the present subject matter are discussed below with reference to FIGS. 1-9.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

The present subject matter will be further described in detail below with reference to the embodiments of the accompanying drawings.

The present subject matter is directed to a removable or retractable panel assembly for an expandable folding table. The removable panel assembly mainly comprises of a movable panel 1*c* and a first frame 3*a*, in which: the first frame 3*a* is a retractable frame that includes a fixed frame 31 and a movable frame 32. The fixed frame 31 is connected with a pivot device of the expandable folding table. A sliding rail device is provided between the movable frame 32 and the fixed frame 31, which can slide back and forth on the fixed frame 31.

According to some embodiments, the movable panel 1*c* is a foldable panel, which is connected to the fixed frame 31 and is rotatable relative to the fixed frame 31, so that the movable panel 1*c* can be supported by the fixed frame 31 when it is inserted between two panels, and the movable panel 1*c* can be hidden under the fixed frame 31 when it is collapsed and stored.

As shown in FIGS. 1-8, the expandable folding table includes foldable table top 100 and foldable table frame 200, wherein each of foldable table top 100 and foldable table frame 200 respectively comprises the movable panel 1*c* and the fixed frame 31.

Figure 8:
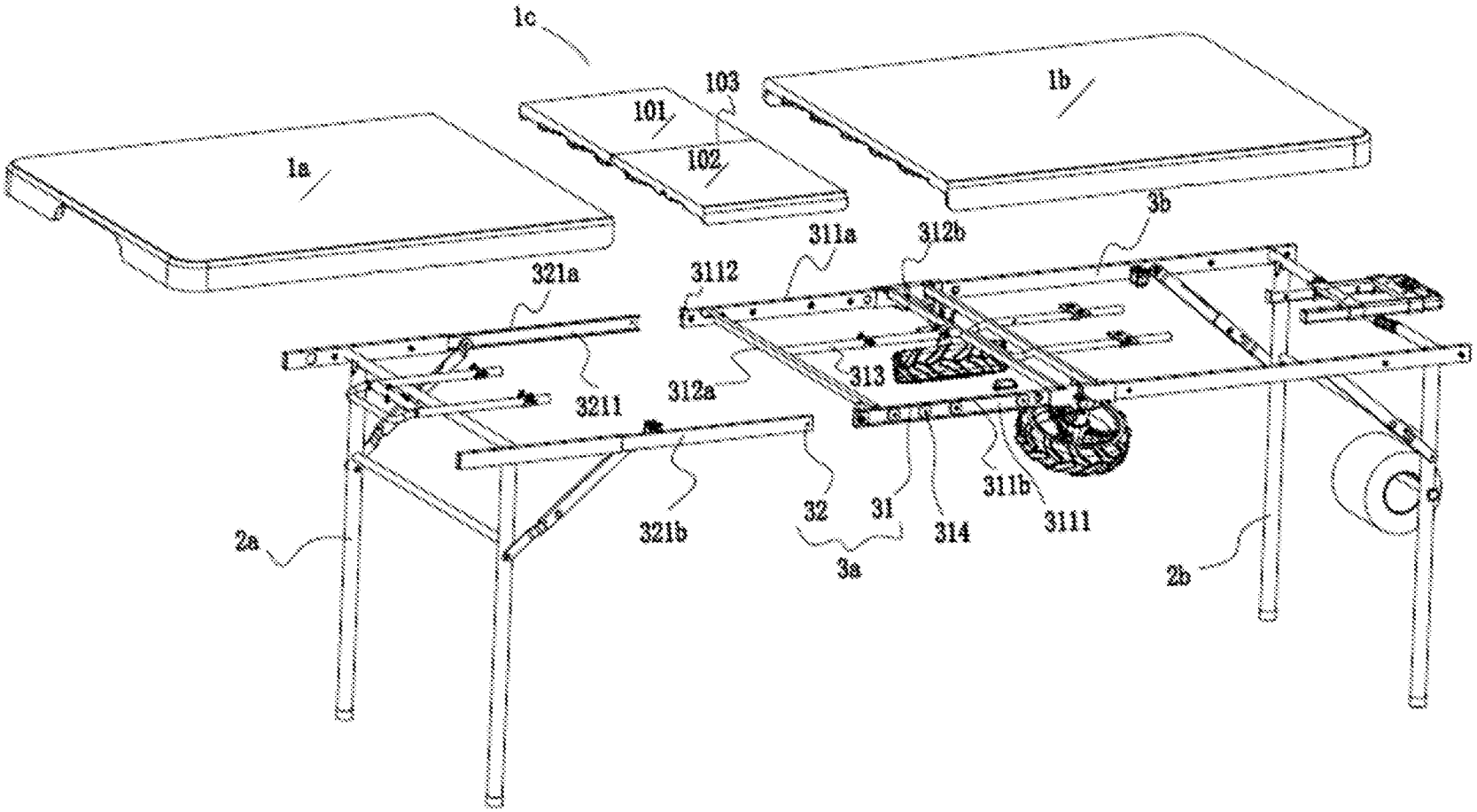
FIG. 8 is a schematic diagram of the first and second panels and the movable panel in FIG. 6 after being disassembled.

According to some embodiments, the foldable table top 100 includes a first panel 1*a*, a second panel 1*b* and a movable panel 1*c*. The first panel 1*a* and the second panel 1*b* have the same shape, size or substantially the same size (as shown in FIG. 8). However, it is not limited to the same size. According to specific needs, the first and second panels 1*a* and 1*b* can be adjusted. The movable panel 1*c* can be inserted between the first and second panels 1*a*, 1*b* to extend the length of the table top. There may be one or more movable panels 1*c*, and the present subject matter discloses one movable panel as an example.

In order to suit the outdoor use of the folding table, the first and second panels 1*a*, 1*b* and the movable panel 1*c* are hollow blow-molded panels (the concave structure at the bottom of the panels is omitted in the figures). According to some embodiments, the opposite sides of the first and second panels 1*a*, 1*b*, that is, the lower parts of the butting surfaces to be butted against each other, are integrally formed with staggered grooves 14 and bumps or protrusions 13. Meanwhile, the upper side of the abutting surfaces has a straight contact to ensure the coupled table top appears to be flat and smooth, while the lower side is fitted and butted with the grooves 14 and the bumps 13 between each other.

Similarly, the left and right sides of the movable panel 1*c* are the butt surfaces that are respectively connected to the first and second panels, and the lower parts of the two sides are also integrally formed with staggered grooves 14 and bumps 13.

Figure 6:
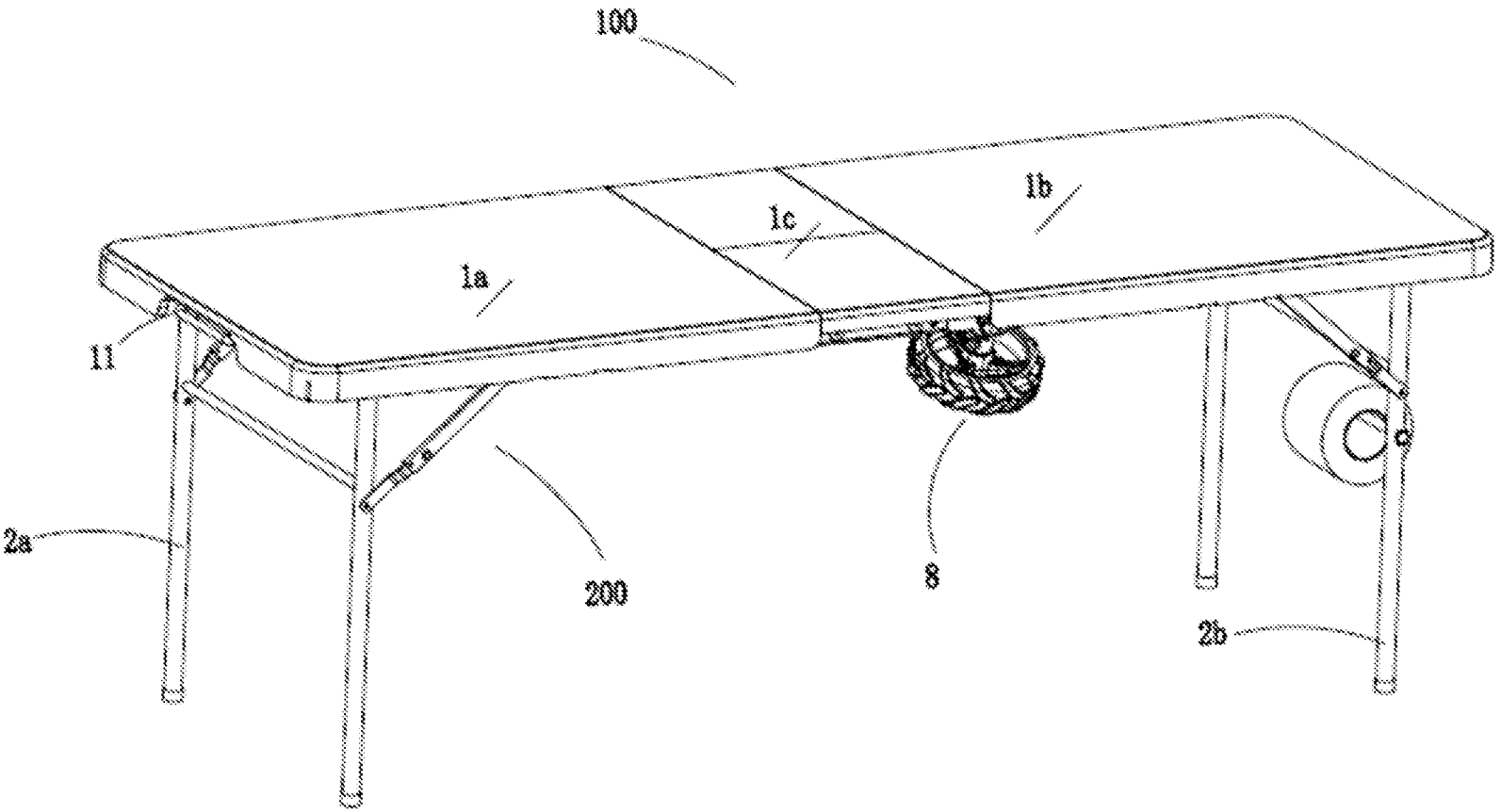
FIG. 6 is a schematic diagram of the extended state of the table top after the movable panel in FIG. 4 is unfolded and inserted.
Figure 7:
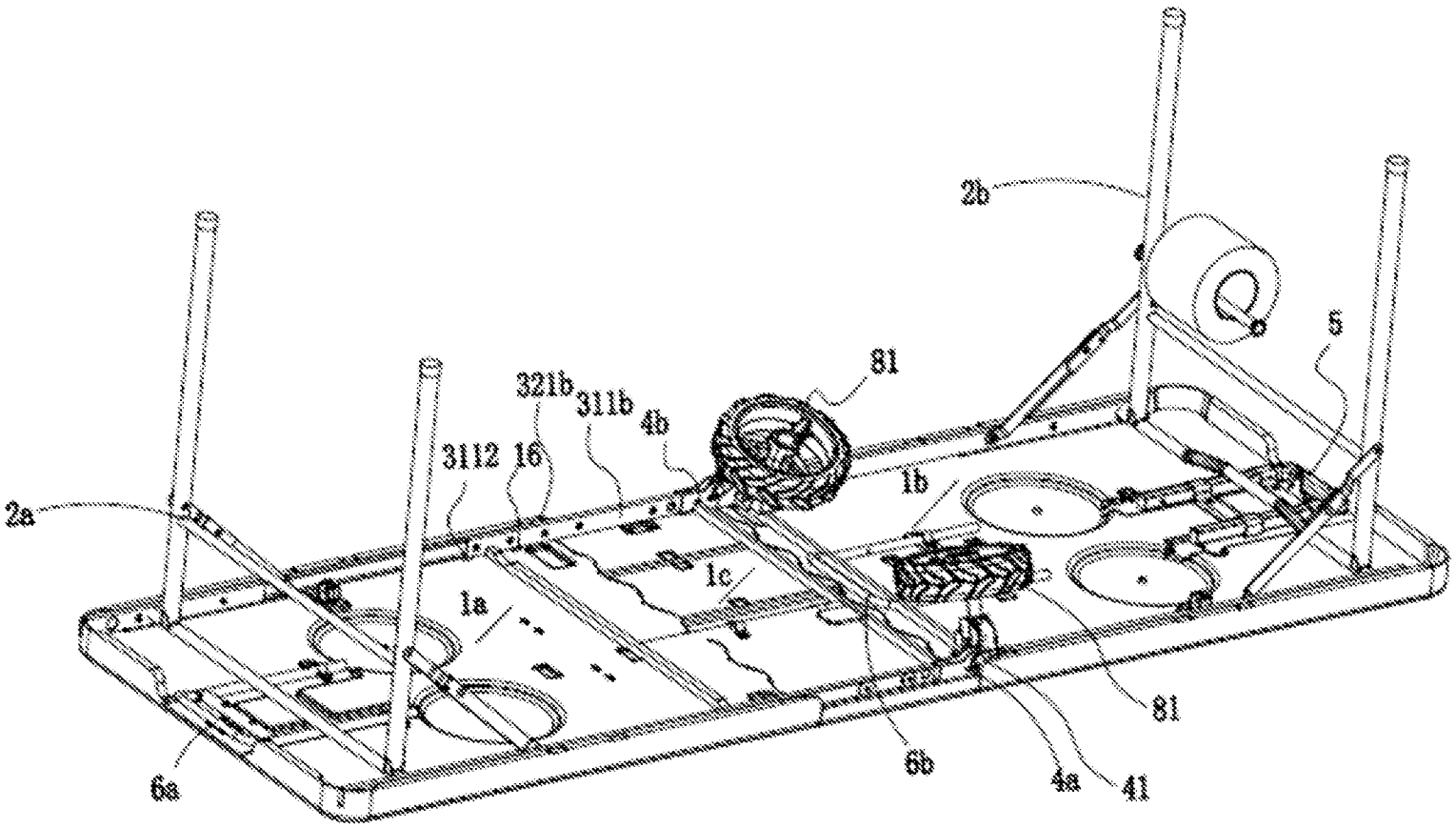
FIG. 7 is a schematic diagram of the inverted view of FIG. 6.

As shown in FIG. 6, when the folding table is open and extended, the movable panel 1*c* is connected to the first and second panels 1*a* and 1*b*, the upper side parts of the butt surfaces are also flat butt joints, and the lower side parts are also fitted and butted with the grooves 14 and the bumps 13. The bumps 13 on the first and second panels 1*a* and 1*b* are fitted with the grooves 14 on the first and second panels 1*a* and 1*b*, and the grooves on the movable panel 1*c* are fitted with the bumps 13 on the first and second panels 1*a* and 1*b*. The aforementioned features can not only improve the structural strength of the coupled panels, but also reduce the joints, and ensure the flatness and aesthetics of the foldable table top 100.

Figure 3:
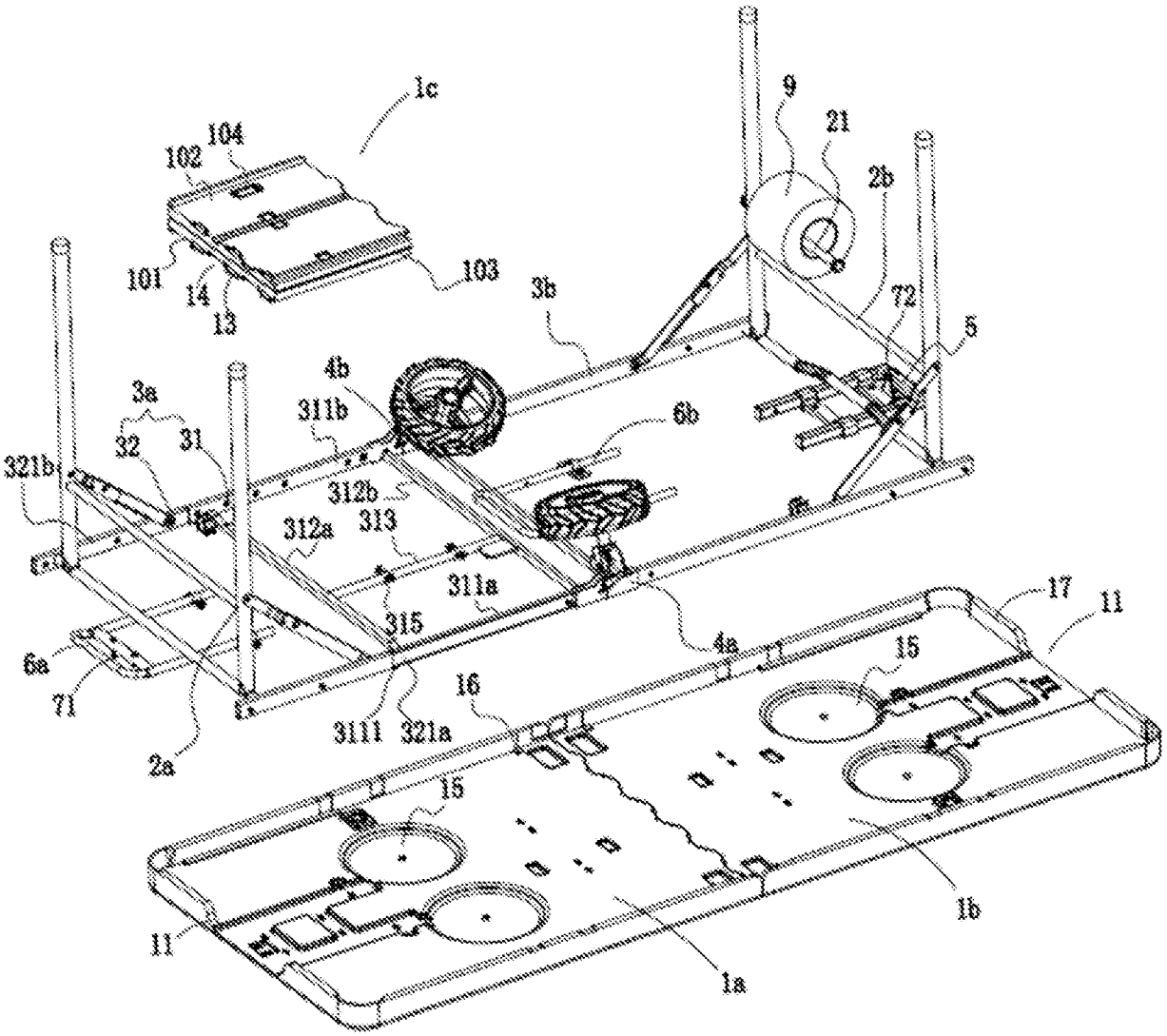
FIG. 3 is a schematic diagram of the disassembled first and second panels and the movable panel in the inverted view of FIG. 1.

As shown in FIG. 3, the movable panel 1*c* is a foldable panel, which comprises a first board 101 and a second board 102 that are connected together, and the connected parts can be folded in half. There can be many mechanisms to connect the two boards. For example, the material skin 103 shown in FIG. 3 can be used to connect the first board 101 and the second board 102, i.e., a plastic joint has thinner material than the two boards'. It can also be connected through hinges so that the movable panel 1*c* can be easily unfolded or folded. In order to prevent the folded first board 101 and the second board 102 from being detached, an anti-detachment device can also be provided between the first board 101 and the second board 102. The device can use a simple magnetic device. That is, the first board 101 and the second board 102 are respectively equipped with strong magnets 104 that can be attracted to each other, so that the unconnected sides of the two boards can be firmly attracted together.

Figure 4:
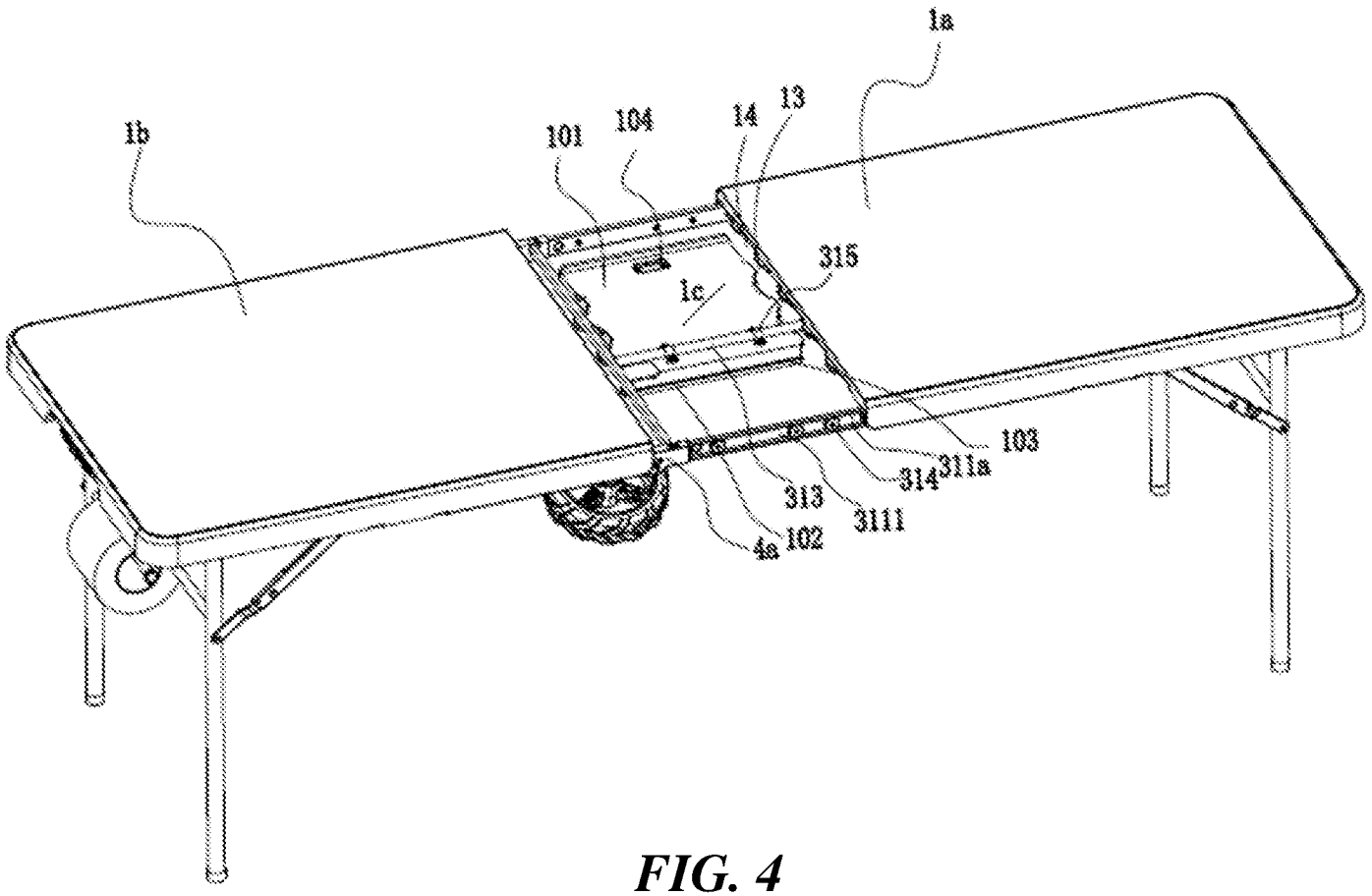
FIG. 4 is a schematic diagram of an embodiment of the present subject matter after the first panel is pulled out.
Figure 5:
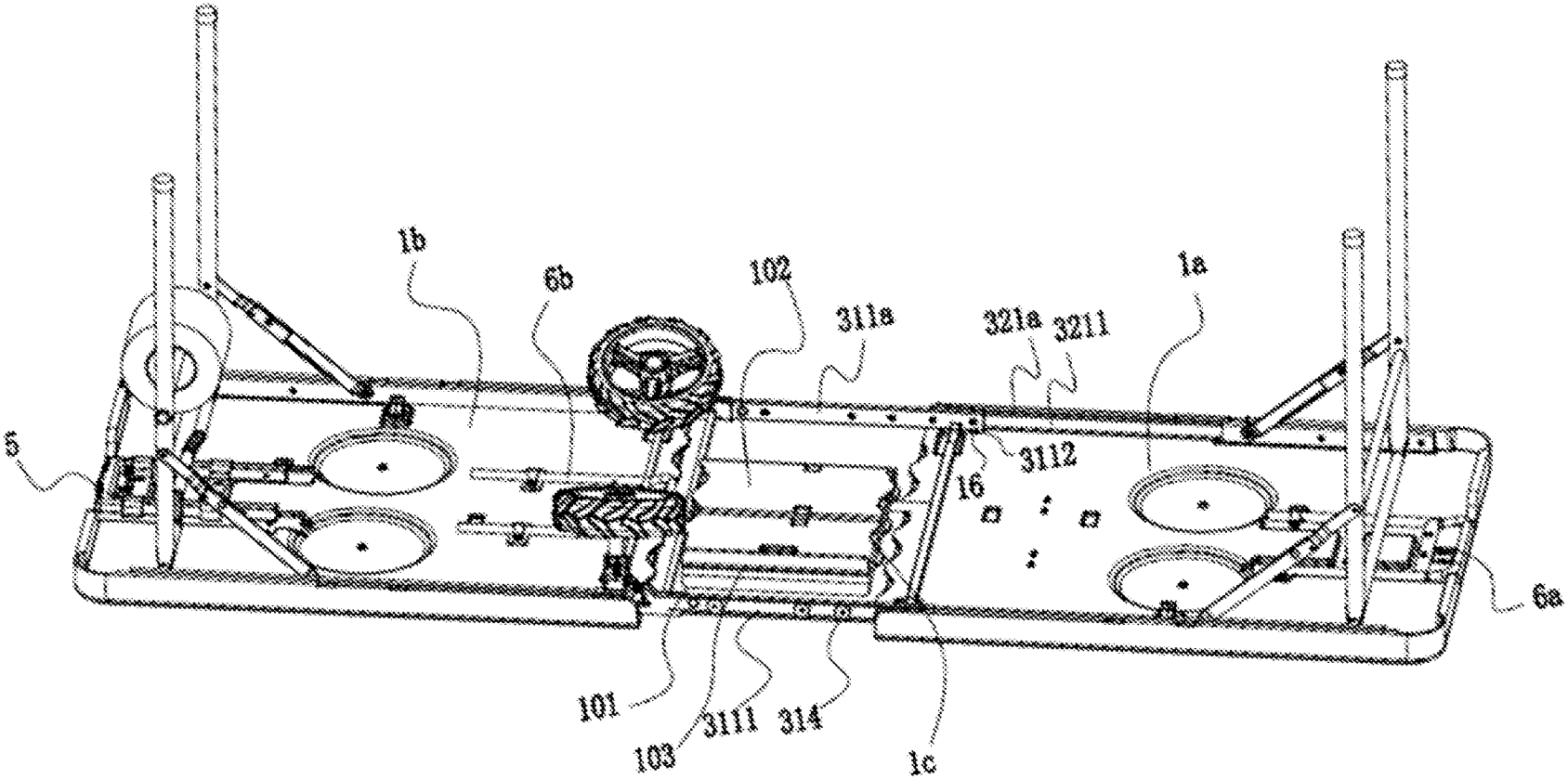
FIG. 5 is a schematic diagram of the inverted view of FIG. 4.

According to some embodiments, the movable panel 1*c* is hidden under the first panel 1*a* when the table top does not need to be lengthened and is rotatably connected to the middle beam 313 of the fixed frame 31. When the table top needs to be extended, after pulling the first panel 1*a*, the movable panel 1*c* can be rotated and inserted. After unfolding the first board 101 and the second board 102, they can be supported on the fixed frame 31 so that the movable panel 1*c* can be locked between the first panel 1*a* and the second panel 1*b*. This way, the extension of the table top is achieved, as shown in FIGS. 4-FIG. 6. The front and rear sides of the movable panel 1*c* are also provided with downwardly extending flanges, which can cover the fixed frame 31.

According to some embodiments, foldable table frame 200 can mainly include a first frame 3*a* and a first stand 2*a* connected to the first panel 1*a*, and a second frame 3*b* and a second stand 3*a* connected to the second panel 1*b*; The first frame 3*a* and the second frame 3*b* are connected by the front and rear pivot devices 4*a*, 4*b* and can be folded around the pivot shaft 41 and linked with the first panel 1*a* and the second panel 1*b* to achieve folding. Among them, the first stand, the second stand, the second frame, and the front and rear pivoting devices can all adopt conventional structures and thus will not be repeated here. However, it should be noted that they can be modified with other well-known technologies except the embodiments as shown here.

According to some embodiments, the first frame 3*a* of the present subject matter is a retractable frame, which includes a fixed frame 31 connected to the front and rear pivoting devices 4*a*, 4*b*, and a movable frame 32 slidably arranged on the fixed frame. The movable panel 1*c* is mounted on the fixed frame and can be rotatably opened. The first panel 1*a* and the first stand 2*a* are fixedly connected to the movable frame 32 and linked with the movable frame 32. A slide rail device is provided between the movable frame 32 and the fixed frame 31, so that the first panel 1*a* can move back and forth on the fixed frame 31. When the table top is to be extended, only the first panel 1*a* needs to be pulled away from the second panel 1*b*, so that the movable panel 1*c* can be pulled out and connected to the second panel 1*b* horizontally. This way, the table top is in the extended state in which the first panel 1*a*, the movable panel 1*c*, and the second panel 1*b* are spliced together, as shown in FIG. 6.

Figure 1:
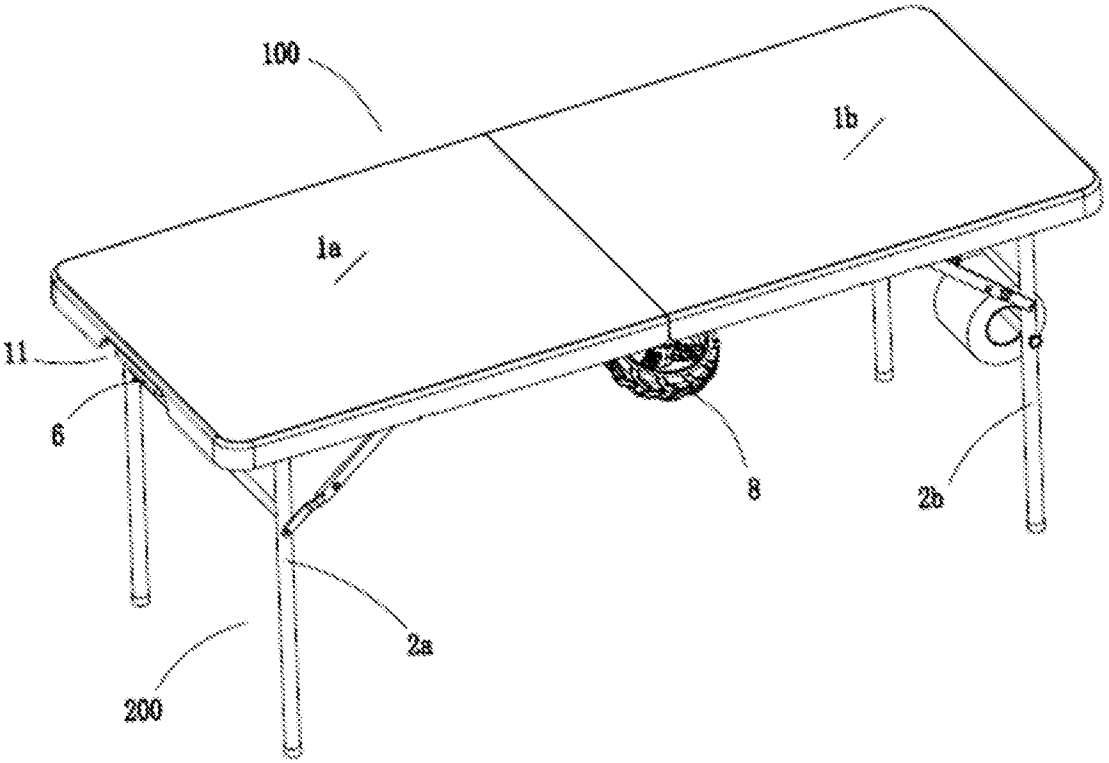
FIG. 1 is a schematic diagram of an embodiment of the present subject matter when the table top is not extended.
Figure 2:
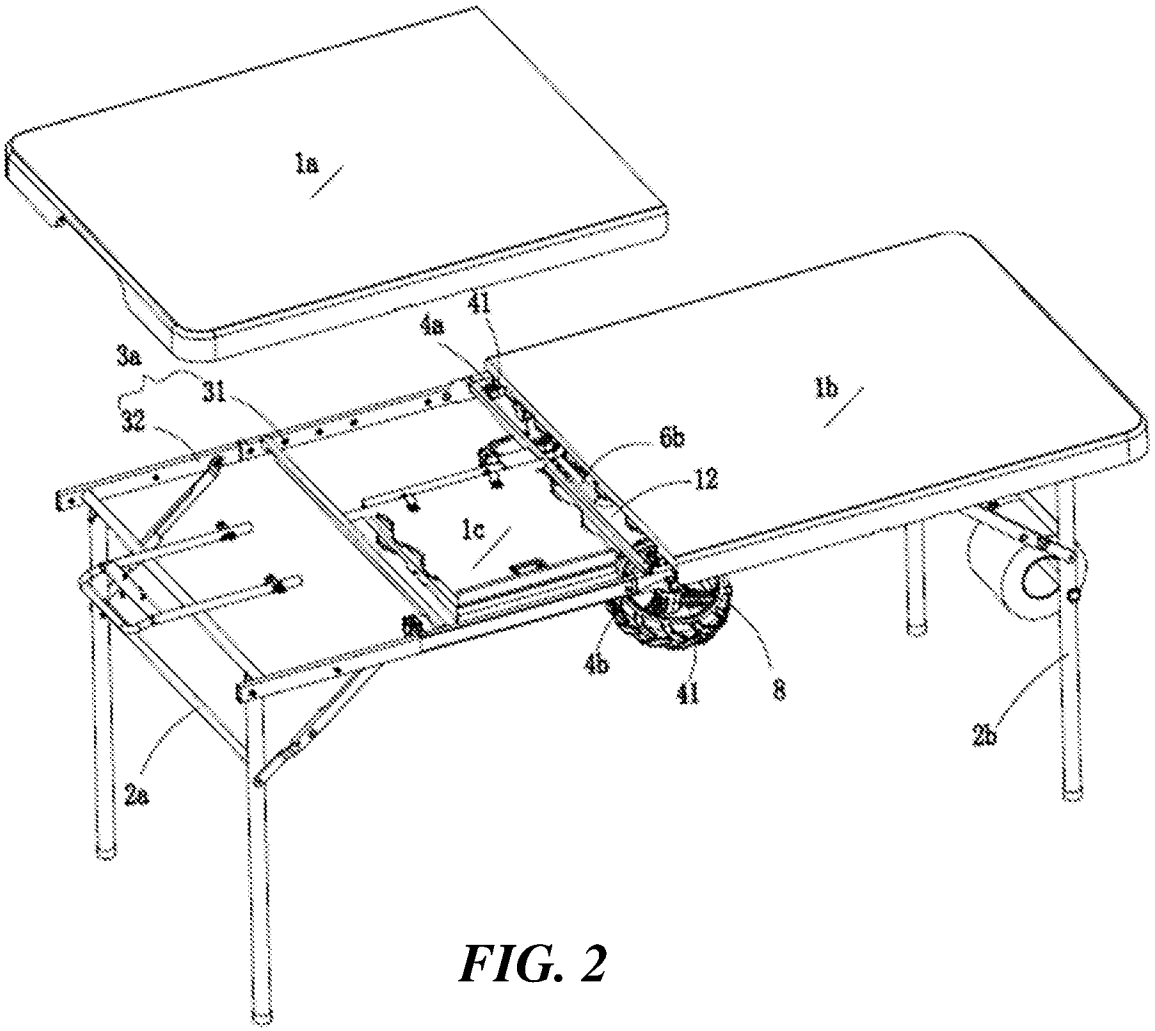
FIG. 2 is a schematic diagram of the first panel in FIG. 1 in an exploded view.

According to some embodiments, when the table does not need to be extended, the first panel 1*a* and the second panel 1*b* are butted, whereas the movable panel 1*c* is folded and stored under the first panel 1*a*. Furthermore, the movable insert panel 1*c* cannot be seen on the table top, as shown in FIGS. 1-3.

According to some embodiments, the fixed frame 31 is roughly in the shape of a square or a rectangle, which includes front and rear side beams 311*a* and 311*b* in the longitudinal direction (referring to the longitudinal direction of the table top), and left and right fixed beams 312*a* and 312*b* in the horizontal direction (referring to the width direction of the table top). The front and rear fixed beams 311*a*, 311*b* are respectively connected with the pivot seats of the front and rear pivoting devices 4*a*, 4*b*, and the right fixed beam 312*b* is connected between the front and rear pivoting devices 4*a*, 4*b*. In order to arrange the middle beam 313 of the movable panel 1*c* longitudinally, it is connected between the left fixed beam 312*a* and the right fixed beam 312*b*. A baffle plate is also extended on the fixed beam 312*b* for supporting and positioning the movable panel 1*c*. The front fixed beam 311*a* and the rear fixed beam 311*b* are both long strip-shaped plates with a "[]"-shaped cross-section, with the grooves on them, are set as fixed sliding rail grooves 3111. A plurality of rolling elements 314 is arranged at intervals in the fixed sliding rail groove 3111. According to some embodiments, the rolling elements 314 can be rollers, bearings, rollers, etc., and are rotatably arranged in the length direction.

According to some embodiments, the shape of the movable frame 32 is basically the same as that of the second frame 3*b*, and the main difference is that the longitudinal front movable beam 321*a* and the rear movable beam 321*b* are designed to be slidable structures matched with the fixed frame 31. Specifically, the front movable beam 321*a* and the rear movable beam 321*b* and the front and rear fixed beams 311*a*, 311*b* are matched with a long strip-shaped plate with a "]"-shaped cross-section, with the groove on it set as a movable sliding rail groove 3211, which is slidably in contact with the outer circular rolling surface of the rolling element 314 in the fixed sliding rail groove 3111.

In addition, a limit structure is provided between the movable sliding rail groove 3211 and the fixed sliding rail groove 3111 to limit the displacement of the movable sliding rail groove 3211 on the fixed sliding rail groove 3111, which can limit the maximum pulling distance of the first panel 1*a*, to prevent infinite pullout. It can be realized by the following structure: a limiting block 3112 is protruded on the lower side of the left ends of the front and rear fixed beams 311*a*, 311*b* respectively, and correspondingly on the front and rear sides of the back of the first panel 1*a* are raised to form a limiting protrusion 16 that can collide with the limiting block 3112. When the limiting protrusions 16 on the first panel 1*a* collide with the limiting blocks 3112 on the front and rear fixed beams 311*a*, 311*b*, the first panel 1*a* can no longer be pulled out, as shown in FIG. 5.

According to some embodiments, the first stand 2*a* is connected with the movable frame 32. When the first panel 1*a* slides back and forth, the movable frame 32 and the first stand 2*a* also move together. Therefore, the bottom of the first panel 1*a* is always supported by movable frame 32 and first tripod 2*a* to ensure its bearing strength.

Figure 9:
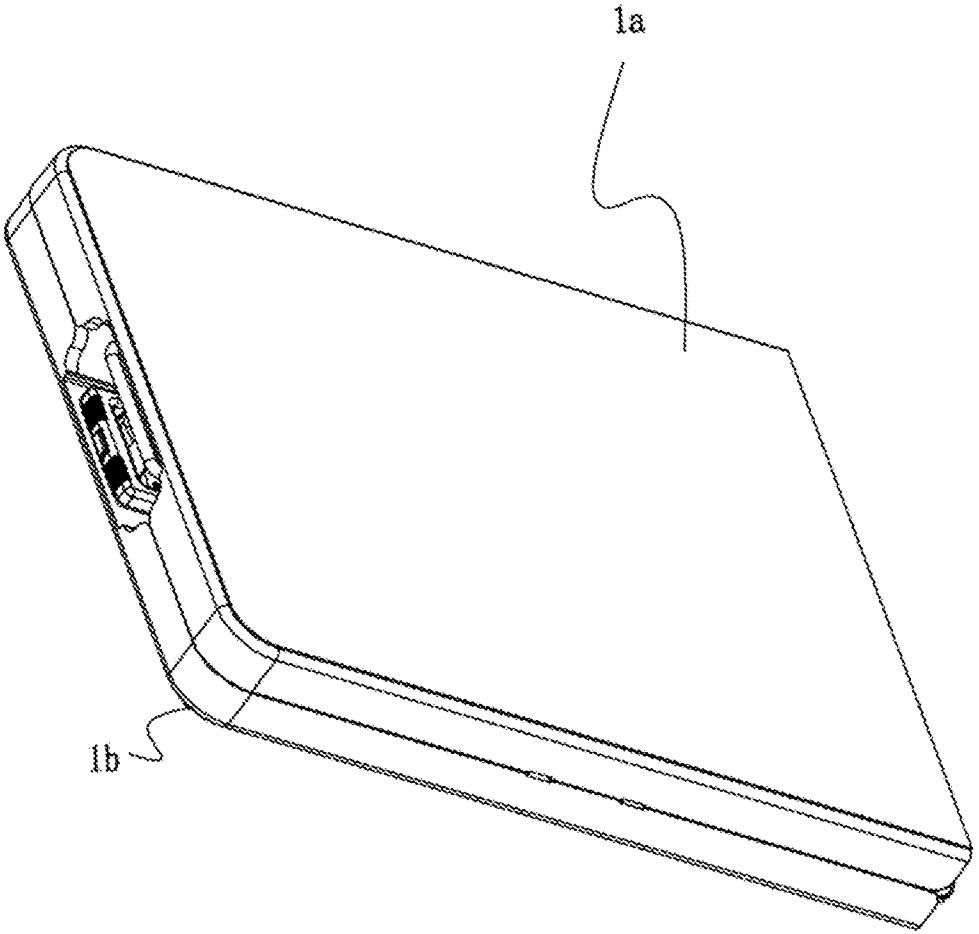
FIG. 9 is a schematic diagram of an embodiment of the present subject matter in a folded and packaged state.

As shown in FIG. 9, when the expandable folding table is folded, the size of it is the same as the size of one panel, which can significantly reduce the packaging volume and transportation cost. The compact size also renders the easy transportation and storage of the table.

Having disclosed exemplary embodiments and the best mode, modifications and variations may be made to the disclosed embodiments while remaining within the scope of the embodiments of the subject matter as defined by the following claims.

What is claimed is:

1. A retractable panel assembly for an expandable folding table with a first panel and a second panel, comprising:

a movable panel and a first frame that is expandable, wherein the first frame includes a fixed frame connected with a pivot device and a movable frame, wherein the pivot device comprises a front pivot device and a rear pivot device and can be folded around a pivot shaft to achieve folding between the first panel and the second panel;

wherein the movable frame is configured to slide on the fixed frame through a sliding rail device between the movable frame and the fixed frame so that the movable panel can be horizontally arranged between the first panel and the second panel to extend the expandable folding table when it is in use, and wherein the movable panel can be hidden under the first panel when it is collapsed, wherein the movable panel is foldable with a first board and a second board that is connected to each other; and wherein the movable panel is foldable and rotatably connected to the fixed frame.

2. The retractable panel assembly of claim 1, wherein the first board and the second board of the movable panel are either connected by hinges or by a flexible integrated structure.

3. The retractable panel assembly of claim 1, wherein the fixed frame includes a longitudinal front fixed beam and a longitudinal rear fixed beam, and a horizontal left fixed beam and a horizontal right fixed beam, wherein the longitudinal front fixed beam and the longitudinal rear fixed beam are respectively connected to the front and rear of the pivot device, wherein the horizontal right fixed beam is connected between the front and rear of the pivot device, wherein the movable frame includes a longitudinal front movable beam and a longitudinal rear movable beam, and the longitudinal front movable beam and the longitudinal rear movable beam are slidably arranged on the longitudinal front fixed beam and the longitudinal rear fixed beam, and wherein a middle beam is a longitudinal beam connected between the horizontal left fixed beam and the horizontal right fixed beam; and wherein the movable panel is rotatably connected to a middle beam of the fixed frame.

4. The retractable panel assembly of claim 3, wherein the sliding rail device further comprises:

the longitudinal front fixed beam and the longitudinal rear fixed beam, each being provided with fixed sliding rail grooves with rolling elements;

the longitudinal front movable beam and the longitudinal rear movable beam are provided with movable sliding rail grooves configured to match with the rolling elements; and a limiting structure for limiting the movable sliding rail grooves on the fixed sliding rail grooves.

5. The retractable panel assembly of claim 4, wherein the rolling elements are one of a roller, or a bearing, or a roller.

6. The retractable panel assembly of claim 1, further comprising:

an anti-detachment device between the first board and the second board when the expandable folding table is folded.

7. The retractable panel assembly of claim 6, wherein the anti-detachment device is a magnet that can attach the first board and the second board to each other.

8. A retractable panel assembly for an expandable folding table with a first panel and a second panel, comprising:

a movable panel with a first board and a second board; and a first frame that is expandable, wherein the first frame includes a fixed frame connected with a pivot device and a movable frame; wherein the pivot device comprises a front pivot device and a rear pivot device and can be folded around a pivot shaft to achieve folding between the first panel and the second panel;

wherein the movable panel can be horizontally arranged between the first panel and the second panel to extend the expandable folding table when it is in use, and wherein the movable panel can be hidden under the first panel when it is collapsed, wherein the movable panel is foldable with the first board and the second board that is connected to each other; and wherein the movable panel is foldable and rotatably connected to the fixed frame.

9. The retractable panel assembly of claim 8, wherein the movable frame is configured to slide on the fixed frame through a sliding rail device between the movable frame and the fixed frame.

10. The retractable panel assembly of claim 9, wherein the sliding rail device further comprises:

a limiting structure for limiting a movable sliding rail grooves on a fixed sliding rail grooves.

11. The retractable panel assembly of claim 8, wherein the first board and the second board are either connected by hinges or by a flexible integrated structure.

12. The retractable panel assembly of claim 8, wherein the fixed frame includes a longitudinal front fixed beam and a longitudinal rear fixed beam, and a horizontal left fixed beam and a horizontal right fixed beam, wherein the longitudinal front fixed beam and the longitudinal rear fixed beam are respectively connected to the front and rear of the pivot device; and wherein the movable panel is rotatably connected to a middle beam of the fixed frame.

13. The retractable panel assembly of claim 12, wherein the horizontal right fixed beam is connected between the front and rear of the pivot device, wherein the movable frame includes a longitudinal front movable beam and a longitudinal rear movable beam, and the longitudinal front movable beam and the longitudinal rear movable beam are slidably arranged on the longitudinal front fixed beam and the longitudinal rear fixed beam, and wherein the middle beam is a longitudinal beam connected between the horizontal left fixed beam and the horizontal right fixed beam.

14. The retractable panel assembly of claim 8, further comprising:

an anti-detachment device between the first board and the second board when the expandable folding table is folded.

15. The retractable panel assembly of claim 14, wherein the anti-detachment device is a magnet that can attach the first board and the second board to each other.

* * * * *